US007018769B2

(12) United States Patent
Stulc

(10) Patent No.: US 7,018,769 B2
(45) **Date of Patent: *Mar. 28, 2006**

(54) LIQUID TONERS COMPRISING ORGANIC PIGMENTS AND METHODS

(75) Inventor: Leonard J. Stulc, Shafer, MN (US)

(73) Assignee: Samsung Electronics Company, Suwon (KR)

( * ) Notice: Subject to any disclaimer, the term of this patent is extended or adjusted under 35 U.S.C. 154(b) by 137 days.

This patent is subject to a terminal disclaimer.

(21) Appl. No.: 10/676,142

(22) Filed: Sep. 30, 2003

(65) Prior Publication Data

US 2005/0069803 A1 Mar. 31, 2005

(51) Int. Cl.
*G03G 9/12* (2006.01)

(52) U.S. Cl. ..... 430/114; 430/117; 430/137.22

(58) Field of Classification Search ..... 430/114, 430/137.22, 117

See application file for complete search history.

(56) References Cited

U.S. PATENT DOCUMENTS

| | | | | |
|---|---|---|---|---|
| 2,922,690 | A | 1/1960 | Meuller et al. | |
| 3,114,726 | A | 12/1963 | Conger et al. | |
| 3,406,162 | A | 10/1968 | Neier | |
| 4,045,424 | A | 8/1977 | Tartter | |
| 4,130,435 | A | 12/1978 | Hall | |
| 4,554,555 | A | 11/1985 | Aruga et al. | 346/1.1 |
| 4,564,574 | A * | 1/1986 | Uytterhoeven et al. | 430/115 |
| 4,576,649 | A | 3/1986 | Oliver et al. | 106/308 Q |
| 4,774,162 | A | 9/1988 | Shibata et al. | 430/213 |
| 5,073,448 | A | 12/1991 | Vieira et al. | 428/331 |
| 5,198,023 | A | 3/1993 | Stoffel | 106/22 R |
| 5,434,030 | A | 7/1995 | Smith et al. | 430/106 |
| 5,766,269 | A | 6/1998 | Berenguer et al. | 8/652 |
| 6,001,524 | A | 12/1999 | Yoon et al. | 430/106 |
| 6,190,735 | B1 | 2/2001 | Radwanski et al. | 427/348 |
| 6,255,363 | B1 | 7/2001 | Baker et al. | |
| 6,342,095 | B1 | 1/2002 | Takizawa et al. | 106/31.27 |
| 6,432,192 | B1 | 8/2002 | Cook et al. | 106/496 |
| 6,444,294 | B1 | 9/2002 | Malhotra et al. | 428/195 |
| 6,468,337 | B1 * | 10/2002 | Gundlach et al. | 106/31.28 |
| 6,508,872 | B1 | 1/2003 | Nguyen et al. | 106/31.47 |
| 6,828,358 | B1 * | 12/2004 | Morrison et al. | 523/160 |
| 2003/0065074 | A1 | 4/2003 | Koshida et al. | |
| 2003/0077542 | A1 | 4/2003 | Arai et al. | 430/281.1 |

FOREIGN PATENT DOCUMENTS

| | | |
|---|---|---|
| DE | 1002366 | 2/1957 |
| DE | 1202920 | 2/1963 |
| DE | 2136996 | 7/1971 |
| FR | 1535980 | 9/1967 |
| GB | 555410 | 8/1943 |
| GB | 1343709 | 1/1974 |

OTHER PUBLICATIONS

U.S. Appl. No. 10/676,140, filed Sep. 30, 2003, entitled "Ionically Complexed Colorants and Methods of Making and Using Same" (20 pgs).

U.S. Appl. No. 10/676,323, filed Sep. 30, 2003, entitled "Black Colorant Compound and Methods of Making and Using Same" (20 pgs).

Kapoor, Sain D., "Fugitive Basic Dye-Based Pigments," Paul Uhlich & Company, Inc. Hastings-on-Hudson, New York, pgs. 573-578.

Lewis, Peter A., "Pigment Handbook," vol. I, Properties and Economics, pp. 133-174 and pp. 189-194 and pp. 265-268.

Willy Herbst, Klaus Hunger, "Industrial Organic Pigments," Production, Properties, Applications, Second, Completely Revised Edition, pp. 560-566, VCH (A Wiley Company).

Lewis, Peter A., "Permanent Basic Dye-Based Pigments," Cincinnati, Ohio, pp. 579-586.

European Search Report, EP 04 25 5875 and Annex dated Jan. 18, 2005.

European Search Report, EP 04 25 5874 and Annex dated Jan. 10, 2005.

* cited by examiner

*Primary Examiner*—John L Goodrow
(74) *Attorney, Agent, or Firm*—Kagan Binder, PLLC

(57) ABSTRACT

Liquid electrographic toner compositions are provided comprising a liquid carrier having a Kauri-Butanol number less than about 30 mL and a plurality of toner particles dispersed in the liquid carrier. The toner particles comprise polymeric binder and a pigment comprising a first ionic dye component ionically complexed with a second ionic dye component in a predetermined ratio to form an ionically complexed colorant compound exhibiting a predetermined color. The colorant compound has a molecular weight of less than about 5000 Daltons and is substantially free of metals that are not covalently bonded to the colorant compound. Toners comprising pigments comprising a ionic dye component and a second ionic dye component complexed to form ionically complexed compounds that together in a colorant composition exhibit a predetermined color are also provided. Methods of making and using these toners are disclosed.

20 Claims, No Drawings

LIQUID TONERS COMPRISING ORGANIC PIGMENTS AND METHODS

FIELD OF THE INVENTION

The invention relates to toners. More specifically, the invention relates to liquid toners comprising ionically complexed dye components, methods of making and using same.

BACKGROUND

In electrophotographic and electrostatic printing processes (collectively electrographic processes), an electrostatic image is formed on the surface of a photoreceptive element or dielectric element, respectively, with a toner. In electrostatic printing, a latent image is typically formed by (1) placing a charge image onto a dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259. In electrophotographic printing, also referred to as xerography, electrophotographic technology is used to produce images on a final image receptor, such as paper, film, or the like. Electrophotographic technology is incorporated into a wide range of equipment including photocopiers, laser printers, facsimile machines, and the like.

Electrophotography typically involves the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, and cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively discharging the charged surface of the photoreceptor in an imagewise manner corresponding to the desired image to be formed on the final image receptor. In the development step, toner particles of the appropriate polarity are generally brought into contact with the latent image on the photoreceptor, typically using a developer electrically-biased to a potential opposite in polarity to the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed.

Finally, in the erasing step, the photoreceptor charge is reduced to a substantially uniformly low value by exposure to light of a particular wavelength band, thereby removing remnants of the original latent image and preparing the photoreceptor for the next imaging cycle.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a liquid carrier. The liquid carrier is typically a nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from about 5 microns to sub-micron, liquid toners are capable of producing very high-resolution toned images.

A typical toner particle for a liquid toner composition generally comprises a visual enhancement additive (for example, a colored pigment particle) and a polymeric binder. The polymeric binder fulfills functions both during and after the electrophotographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like.

Typical colored pigment particles previously used in toners are generally characterized in the classes of dyes, pigments and lakes. A dye is defined in Webster's dictionary as "a usually soluble substance for staining or coloring e.g. fabrics or hair." Likewise, Webster's defines pigment as "dry coloring matter (especially an insoluble powder to be mixed with a liquid to produce paint etc)." A lake is defined as "A pigment formed by combining some coloring matter, usually by precipitation, with a metallic oxide or earth, esp. with aluminium hydrate; as, madder lake; Florentine lake; yellow lake, etc." Lake pigments are conventionally prepared by the precipitation of a soluble organic dye on to an insoluble, inorganic, adsorptive substrate. The pigment is formed by the chemical reaction that occurs when a suitable reagent, such as alum, is added to an aqueous solution containing the dyestuff and, usually, one or more other chemicals, such as sodium or potassium carbonate.

Permanent pigments have been sought to provide lasting color in various applications. For example, U.S. Pat. No. 4,576,649 to Oliver, et. al. discloses preparation of permanent pigments from selected cationic dyes by precipitation from aqueous solution with complex heteropoly acids in the presence of selected amine color enhancing agents. These pigments are stated to be of interest in formulating high quality lithographic inks.

Colorants comprising bound dyes have been incorporated into toners for electrostatographic printing and copying processes. For example, U.S. Pat. No. 5,434,030 to Smith, et al. discloses a toner composition including a resin, a charge enhancing additive, an ion binding polymer, and at least one ionic dye complexed to the ion binding polymer. The ionic dye is a component that is different from the charge enhancing additive, and is stabilized and dispersed in the toner composition.

U.S. Pat. No. 5,766,269 to Berenguer, et. al. describes cationic dyes comprising at least one quaternary ammonium group or protonated or protonizable tertiary amino group and at least one chromophoric radical, wherein the chromophoric radical is the radical of an optionally (pre)reduced sulphur dye, its precursor containing a cationic group which is a secondary amino group of basic character. These dyes are stated to be combinable with an anionic desolubilizer to form a water insoluble dye. Examples of desolubilizers include, among other examples, anionic dyes. See column 15, lines 37–50.

U.S. Pat. No. 6,001,524 to Yoon discloses toner particles for color electrophotographic imaging applications. The particles are based on substantially amorphous polyesters that contain functionalities that are capable of being reacted with coloring reagents to form dyed polyester particles, which after further treatment are incorporated into toner compositions.

SUMMARY OF THE INVENTION

Liquid electrographic toner compositions are provided, comprising a liquid carrier having a Kauri-Butanol number less than about 30 mL and a plurality of toner particles dispersed in the liquid carrier. The toner particles comprise polymeric binder and an organic pigment comprising a first ionic dye component ionically complexed with a second ionic dye component in a predetermined ratio to form an ionically complexed colorant compound exhibiting a predetermined color. The pigment has a molecular weight of less than about 5000 Daltons and is substantially free of metals that are not covalently bonded to the colorant compound. The organic pigment is insoluble in the liquid carrier and is insoluble in water.

Additionally, toners are provided wherein the pigment is a composition comprising ionic dye components ionically complexed in a predetermined ratio to form ionically complexed compounds that together in a colorant composition exhibit a predetermined color.

In a preferred aspect of the present invention, a plurality of dye components may be complexed with a colorless counterion. For purposes of the present invention, a colorless counterion component is a component that under conditions of use does not exhibit a color in the visible light range. This facilitates color selection by providing an ability to easily select the desired ratio and concentration of dye ionic components in the overall composition. In one embodiment of this aspect, and all dye components have the same charge, and the colorless ion is the counterion to ally dye components. In another embodiment of this aspect, the compound comprises a first dye ionic component having a colorless counterion, and at least a second dye ionic component that has the same charge or the opposite charge as the first dye ionic component.

Methods of preparing these toners, and methods of use of these toners are also provided.

For purposes of the present invention, a composition is stated to have an apparent color when evaluated in a manner to indicate the color that an observer under ordinary viewing conditions for the composition would ascribe to that composition, notwithstanding individual color inhomogeneities that might otherwise be observed when examining at higher magnifications. A dye component is an ion (or counterion) that exhibits an apparent color in the visible light range to the ordinary observer.

Toners of the present invention utilize unique pigment chemistries that afford formulation options not previously available in the art through the ability to use materials having unique solubility properties both prior to and after complexation. The resulting colorant preferably exhibits less migration from the toner to undesired environments, such as staining various surfaces in which the toner may come in contact. Additionally, the colorants of the present invention surprisingly can be formulated to have low solubility or be substantially insoluble in water or other selected carrier solvents. Low solubility in the colorant carrier solvent is achieved by compounds that are substantially free of metals that are not covalently bonded to the pigment. Thus, the present invention provides an "organic lake," meaning that the pigment is substantially free of inorganic metal counterions, and in particular, heavy metal counterions.

Because the pigments of the present invention are non polymeric, they present advantages in milling properties, dispersibility properties, charge properties and chemical interaction properties that were not previously available. Non-polymeric pigments may have a less disruptive effect on the melting and coalescing properties of the overall toner particle. Further, premature agglomeration and retention of moisture sensitive sites may be observed as compared to certain prior pigment compositions. The use of a plurality of dye components in the present pigment provides unique color properties in the present toner compositions.

The present invention additionally provides substantial benefit in easily expanding the choice of colors for use in toners. Colorants are always subject to testing to determine the effect of the chemistries employed on our environment, and also specifically on human health through direct contact or ingestion of the colorant. The identification and approval of new colors may be an expensive and drawn out clearing process due to the above concerns. The present invention allows the preparation of new colors without the need to create totally new molecules that require a full de novo clearance process. Instead, new colors may now be formed by complexing previously known (and preferably already cleared) dye molecules to form an apparently new color that incorporates partially old chemistry. Additionally, the apparent color of the composition may be fine-tuned to the exact desired hue by adjusting relative dye content as taught herein. Because the dye components are complexed to each other, the resulting color is stable in most environmental conditions without concern of differential chemical properties leading to a change in ratio of the different dyes as may occur in dye blends that are merely physically blended.

Additionally, because a great portion of the colorant compound comprises material that contributes to the apparent color, toners of the present invention may exhibit surprisingly high color saturation and/or brilliance as compared to conventional lakes or other colorants.

DETAILED DESCRIPTION

As noted above, the pigments for use in toners of the present invention contain no polymeric components. Such pigments are of particular benefit because it is easier to assure full coordination of all ionic sites when reacting only monomeric materials. Thus, larger compounds may have a tendency to prematurely insolubilize during the dye binding process prior to coordination of all ionic sites. Ionomers in particular may prematurely agglomerate before the desired colorant compound is formed. The presence of uncomplexed sites on a polymeric component may additionally provide regions of instability with respect to moisture, which may be problematic particularly if the final application of the colorant is in an environment where the colorant is exposed to moisture through, for example, skin contact or ambient humidity. The resulting image may be tacky or sensitive to water. Additionally, non-polymeric colorant compounds may be easier to process, handle, mill to the desired size and consistency and disperse into various resins or compositions. Further, colorant compositions that do not contain polymeric components do not provide an additive Tg that may adversely affect the predetermined balance of the binder. In a preferred embodiment, the colorant compound has a molecular weight of less than about 5000 Daltons. In another preferred embodiment, the colorant compound has a molecular weight of less than about 3000 Daltons.

Preferably, the pigment used in the toner of present invention has a water solubility of less than 100 parts per million. In addition, preferably the pigment has a solubility in various carrier solvents such as ketones, alcohols, esters, glycol ethers and esters, aliphatic and aromatic hydrocarbons and the like of less than 100 parts per million.

Colorants of the present invention exhibit a color that is visible and apparent to the human eye. The actual color exhibited may be measured and/or evaluated using any appropriate technique suitable for the particular application. One such color measuring technique is the CIE L*A*B* color system, as described in "Principles of Color Technology", Billmeyer & Saltzman, Second Edition, 1981. This system is based on a 3-dimensional color space with the positive X-axis representing red, the negative X-axis representing green, the positive Y-axis representing yellow, the negative Y-axis representing blue, and the Z-axis going from zero (black) to 100 (white) with the origin at 50. The CIE ΔE* (hereafter "ΔE*"), is defined as a measure of color difference, namely the Euclidean distance or the straight line distance between two colors that are expressed by the Lab coordinates.

Because the CIE Lab color-space would be a perceptually uniform color-space, then the Euclidean distance between two colors in this space would be a perceptually uniform measure for color-difference. The ΔE* is calculated as:

$$\Delta E^* = [(L1-L2)^2+(a1-a2)^2+(b1-b2)^2]^{(1/2)} \text{ where:}$$

L1, a1 and b1 are the Lab values of color 1 and

L2, a2 and b2 are the Lab values of color 2.

In this measurement system, it can be generally stated that if two samples have a measured color difference of at least about 10 ΔE* units, this color difference is of a degree that can be observed by the human eye.

In a preferred embodiment of the present invention at least two of the dye components when measured separately exhibit a color difference of at least about 10 ΔE* units. The resulting color of the colorant complex is therefore a mixture of the apparent colors of each of the dye components. In a particularly preferred embodiment of the present invention, at least two of the dye components exhibit a color difference of at least 20 ΔE* units. Thus, in this embodiment, the degree of difference in color of each component from the other would be quite apparent to visible perception. However, due to the close proximity of the dye components to each other, the apparent resulting color of the colorant is a blend of the two colors. This embodiment of the present invention provides a high precision of color matching and stability, with little or no issues of color separation that might be observed by merely blending two or more individual colorants that may have different solubility or dispersibility characteristics from each other.

In an alternative preferred embodiment, all dye components in the colorant exhibit a color difference of less than about 10 ΔE* units from each other. In this embodiment, the apparent color of each dye in the colorant is close in appearance to each other. This embodiment provides a colorant that exhibits a particularly rich and deep apparent color to the visual observer.

The ionic dye components of the present pigment may be provided in any ionically complexed configuration. In a preferred embodiment, one of these dye components is an anionic dye and the other dye component is a cationic dye. In another embodiment of the present invention, the first ionic dye component and the second ionic dye component have the same charge, i.e. are both anionic dye components or are both cationic dye components. In this embodiment, the ionic dye components are ionically complexed with a colorless counterion. Preferably, the colorless counterion component of the ionically complexed colorant compound is a relatively small portion of the overall colorant. This embodiment is of benefit, because a larger portion of the colorant actually contributes to the effective color that is observed, providing a more effective colorant that can be present as a smaller amount in the overall ultimate composition, while still having the desired colorant effect. In one preferred embodiment, the colorless counterion component comprises less than about 40% of the total colorant compound by weight. In another preferred embodiment, the colorless counterion component comprises less than about 20% of the total colorant compound by weight. In another preferred embodiment, the colorless counterion component comprises less than about 10% of the total colorant compound by weight.

Preferably, the colorant is a single compound having the first ionic dye and the second ionic dye (and any additional counterions as discussed herein) complexed at the preselected ratio, so that each compound per se will have the desired ratio of components to achieve the desired apparent color. It will be understood that some ion exchange may occur in situ, or that in some preparation processes some compound pairs or groups may be formed, so that the pair taken together exhibits the desired apparent color. Likewise, a grouping of three or more compounds may be formed in a like manner, so that the group taken together exhibits the desired apparent color. For purposes of the present invention, a certain amount of this pairing or grouping is contemplated on a molecular level, and the pair or group is considered to be within the scope of a colorant compound as described herein.

In another embodiment of the present invention, predetermined combinations of ionically complexed dyes and additional counterions may be prepared to ionically complex all components in the desired ratio in a single composition, without regard to whether these components are complexed with each other in a single compound. In this embodiment, preferably all ionic components are ionically complexed so that each compound in the composition is insoluble in water and in the carrier liquid of the ultimate coloring composition, so that no separation of the compounds from each other occurs under manufacture or use conditions. These colorant compositions may be formulated with additional ingredients and used in the manner of the compounds as described herein.

In one embodiment of the present invention, the pigment comprises a combination of three or more dyes. In such a system, a first ionic dye may be complexed with second and third dyes that are of opposite charge to the first ionic dye. For example, a first cationic dye may be complexed with a second anionic dye and a third anionic dye. In a preferred embodiment, the first ionic dye comprises a plurality of ionic functionalities on the ionic dye component, so that a single ionic dye component is capable of coordinating with a plurality of counterions. In a preferred embodiment, all dyes in the pigment exhibit a color difference of at least about 10 ΔE* units from each other. The apparent color of the colorant may be adjusted by varying the relative amounts of each of the three dyes in the total colorant composition. Optionally, one or more of the counterions is a colorless counterion. The apparent color of the colorant composition may be modulated by incorporation of more or less of the colorless counterion as desired. Preferably, the colorless counterion is an organic counterion. The use of a plurality of dye counterions in particular provides a high precision of color matching with little or no issues of color separation that might be observed by merely blending two or more individual colorants that may have solubility or dispersibility characteristics that are different from each other.

The anionic dyes to be used in the present invention may be any dye having a negative charge that is capable of complexing with a cationic counterion as taught herein. In one aspect of the present invention, the anionic dye comprises a plurality of negatively charged functionalities, sterically located so that the anionic dye is capable of complexing with a plurality of cationic counterions. Preferred anionic dyes are those that contain one or more sulfonate groups, carboxyl groups and/or hydroxyl salt groups. Examples of such anionic dyes include, but are not limited to, sulfonate salts of phthalocyanine, azo-, pyrazoline and anthraquinone dyes, and mixtures thereof. Additional examples of such anionic dyes include Acid Alizarin Violet, Acid Yellow 40, Acid Red 4, Acid Blue 25, Acid Violet 7, Phloxine B, copper phthalocyaninetetrasulfonic acid tetrasodium salt, Quinoline yellow, Acid yellow 17, Tartrazine, Alizarin Yellow GG, Reactive Black 5, Eosin Y, Erioglaucine, Acid Red 91, Acid Red 51, and Food Black 1.

The cationic dyes to be used in the present invention may be any dye having a positive charge that is capable of complexing with an anionic counterion as taught herein. In one aspect of the present invention, the cationic dye comprises a plurality of positively charged functionalities, sterically located so that the cationic dye is capable of complexing with a plurality of anionic counterions. Preferred cationic dyes to be used in the present invention contain one or more quaternary ammonium, sulfonium, phosphonium and oxonium groups. Examples of such cationic dyes include, but are not limited to, Tetrazolium Violet, Rhodamine B, Indoine Blue, Auramine 0, mixtures thereof and the like. Additional examples of such cationic dyes are selected from the group consisting of Color Index Basic Red 12, Color Index Basic Red 14, Color Index Basic Red 28 and Color Index Basic Violet 10, Basic Yellow 1, Alcian Blue-tetrakis(methylpyridium)chloride, Basic Blue 41 and Basic Red 1.

The colorless counterion component may be any colorless counterion that is capable of complexing with the dye ion as taught therein. In a preferred embodiment, the colorless counterion comprises a plurality of functionalities available for coordination with the dye, so that a plurality of dye ions may be complexed with a single colorless counterion. The colorless counterion, when the dye to be complexed with is an anion, preferably is a cationic compound selected from quaternary ammonium salts, sulfonium salts, phosphonium salts, oxonium salts and any combination thereof of alkyl, aryl and alkyl/aryl compounds. The colorless counterion, when the dye to be complexed with is a cation, preferably is an anionic compound selected from sulfonates, carboxylates, hydroxyl salts and any combination thereof of alkyl, aryl and alkyl/aryl compounds.

In a particularly preferred embodiment of the present invention, the ionic dyes are selected so that the ultimate colorant compound exhibits the apparent color of either yellow, magenta, cyan, or black. These colors are the four colors used in traditional printing presses. By using well recognized combinations or blends of these four colors, nearly all desired colors can be obtained. The present invention provides a system for provision of stable and reproducible colorants of each of these four colors, which is a significant benefit to the art.

In a preferred embodiment of the present invention, the anionic dyes and the cationic dyes are water soluble prior to being complexed with each other. When solutions of each are combined, a water insoluble precipitate is formed. Optionally, a water miscible solvent may be added to increase solubility of either the cationic components, the anionic components, or both; particularly where the concentration of reactants in the reaction composition is high in order to reduce the volume of the reactant solution to a manageable level. After precipitation, the counter ions that were associated with the anionic and cationic reactants remain in solution. The precipitate is isolated by filtration and preferably washed with more water to remove any remaining soluble counter ions. This washing process optionally may be repeated several times. The precipitate is then dried and can then be used as a colorant. Preferably, the colorants of the present invention are not soluble in water. Water insolubility both eases handling of the colorant, and also provides a benefit in reducing the amount of staining of various surfaces during subsequent application or use of the colorant.

Colorants of the present invention are particularly suited for use in toners used in the copying and printing industry. Most particularly, the present colorants are useful for incorporation in either liquid or dry toners for electrophotography. The colorants are readily compatible with desired toner chemistries, and further may result in toners that exhibit superior charge transfer characteristics. Electrophotographic printing processes use electrostatic transfer to move images made of discrete toner particles from one surface to the next. The charging of these toner particles is very important in this transfer process. Ionic dyes that are complexed with another ionic dye, rather than a heavy metal ion, exhibit different charge and transfer properties, thereby providing opportunity for improvement in toner transfer.

When used as part of a toner composition, various suitable toner resins may be selected for incorporation with the colorant of the present invention. Illustrative examples of typical resins include polyamides, epoxies, polyurethanes, vinyl resins, polycarbonates, polyesters, and the like and mixtures thereof. Any suitable vinyl resin may be selected including homopolymers or copolymers of two or more vinyl monomers. Typical examples of such vinyl monomeric units include: styrene; vinyl naphthalene; ethylenically unsaturated mono-olefins such as ethylene, propylene, butylene, isobutylene and the like; vinyl esters such as vinyl acetate, vinyl propionate, vinyl benzoate, vinyl butyrate and the like; ethylenically unsaturated diolefins, such as butadiene, isoprene and the like; esters of unsaturated monocarboxylic acids such as methyl acrylate, ethyl acrylate, n-butyl acrylate, isobutyl acrylate, dodecyl acrylate, n-octyl acrylate, phenyl acrylate, methyl methacrylate, ethyl methacrylate, butyl methacrylate and the like; acrylonitrile; methacrylonitrile; vinyl ethers such as vinyl methyl ether, vinyl isobutyl ether, vinyl ethyl ether and the like; vinyl ketones such as vinyl methyl ketone, vinyl hexyl ketone, methyl isopropenyl ketone and the like; and mixtures thereof. Also, there may be selected as toner resins various vinyl resins blended with one or more other resins, preferably other vinyl resins, which insure good triboelectric properties and uniform resistance against physical degradation. Furthermore, nonvinyl type thermoplastic resins may also be employed including resin modified phenolformaldehyde resins, oil modified epoxy resins, polyurethane resins, cellulosic resins, polyether resins, polyester resins, and mixtures thereof.

Preferably, the toner comprises a graft amphipathic copolymer that has been dispersed in a liquid carrier to form an organosol, then mixed with other ingredients to form a liquid toner composition. Typically, organosols are synthesized by nonaqueous dispersion polymerization of polymerizable compounds (e.g. monomers) to form copolymeric binder particles that are dispersed in a low dielectric hydrocarbon solvent (carrier liquid). These dispersed copolymer particles are sterically-stabilized with respect to aggregation by chemical bonding of a steric stabilizer (e.g. graft stabilizer), solvated by the carrier liquid, to the dispersed core particles as they are formed in the polymerization. Details of the mechanism of such steric stabilization are described in Napper, D. H., "Polymeric Stabilization of Colloidal Dispersions," Academic Press, New York, N.Y., 1983. Procedures for synthesizing self-stable organosols are described in "Dispersion Polymerization in Organic Media," K. E. J. Barrett, ed., John Wiley: New York, N.Y., 1975.

Liquid toner compositions have been manufactured using dispersion polymerization in low polarity, low dielectric constant carrier solvents for use in making relatively low glass transition temperature (Tg<30° C.) film-forming liquid toners that undergo rapid self-fixing in the electrophotographic imaging process. See, e.g., U.S. Pat. Nos. 5,886,067 and 6,103,781. Organosols have also been prepared for use in making intermediate glass transition temperature (Tg between 30–55° C.) liquid electrostatic toners for use in electrostatic stylus printers. See, e.g., U.S. Pat. No. 6,255,363 B1. A representative non-aqueous dispersion polymerization method for forming an organosol is a free radical polymerization carried out when one or more ethylenically-unsaturated monomers, soluble in a hydrocarbon medium, are polymerized in the presence of a preformed, polymerizable solution polymer (e.g. a graft stabilizer or "living" polymer). See U.S. Pat. No. 6,255,363.

Once the organosol has been formed, one or more additives can be incorporated, as desired. For example, one or more visual enhancement additives and/or charge control agents can be incorporated. The composition can then subjected to one or more mixing processes, such as homogenization, microfluidization, ball-milling, attritor milling, high energy bead (sand) milling, basket milling or other techniques known in the art to reduce particle size in a dispersion. The mixing process acts to break down aggregated visual enhancement additive particles, when present, into primary particles (having a diameter in the range of 0.05 to 5 microns) and may also partially shred the dispersed copolymeric binder into fragments that can associate with the surface of the visual enhancement additive.

According to this embodiment, the dispersed copolymer or fragments derived from the copolymer then associate with the visual enhancement additive, for example, by adsorbing to or adhering to the surface of the visual enhancement additive, thereby forming toner particles. The result is a sterically-stabilized, nonaqueous dispersion of toner particles having a volume mean particle diameter (determined with laser diffraction) in the range of about 0.05 to about 50.0 microns, more preferably in the range of about 3 to about 10 microns, most preferably in the range of about 1.5 to about 5 microns. In some embodiments, one or more charge control agents can be added before or after mixing, if desired.

Several characteristics of liquid toner compositions are important to provide high quality images. Toner particle size and charge characteristics are especially important to form high quality images with good resolution. Further, rapid self-fixing of the toner particles is an important requirement for some liquid electrophotographic printing applications, e.g. to avoid printing defects (such as smearing or trailing-edge tailing) and incomplete transfer in high-speed printing. For example, in organosol toner compositions that exhibit low Tgs, the resulting film that is formed during the imaging process may be sticky and cohesively weak under transfer conditions. This may result in image splitting or undesired residue left on the photoreceptor or intermediate image receptor surfaces. Another important consideration in formulating a liquid toner composition relates to the durability and archivability of the image on the final receptor. Erasure resistance, e.g. resistance to removal or damage of the toned image by abrasion, particularly by abrasion from natural or synthetic rubber erasers commonly used to remove extraneous pencil or pen markings, is a desirable characteristic of liquid toner particles.

The liquid carrier is a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water. The carrier liquid may be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™

L, Isopar™ M and Isopar™ V (available from Exxon Corporation, NJ), and most preferred carriers are the aliphatic hydrocarbon solvent blends such as Norpar™ 12, Norpar™ 13 and Norpar™ 15 (available from Exxon Corporation, NJ). Particularly preferred carrier liquids have a Hildebrand solubility parameter of from about 13 to about 15 $MPa^{1/2}$.

The liquid carrier of the toner compositions of the present invention is preferably the same liquid as used as the solvent for preparation of the amphipathic copolymer. Alternatively, the polymerization may be carried out in any appropriate solvent, and a solvent exchange may be carried out to provide the desired liquid carrier for the toner composition.

In addition to the colorant of the present invention, other additives optionally can be formulated into the liquid toner composition. A particularly preferred additive comprises at least one charge control agent (CCA, charge control additive or charge director). The charge control agent, also known as a charge director, can be included as a separate ingredient and/or included as one or more functional moiety(ies) of the S and/or D material incorporated into the amphipathic copolymer. The charge control agent acts to enhance the chargeability and/or impart a charge to the toner particles. Toner particles can obtain either positive or negative charge depending upon the combination of particle material and charge control agent.

The charge control agent can be incorporated into the toner particles using a variety of methods, such as copolymerizing a suitable monomer with the other monomers used to form the copolymer, chemically reacting the charge control agent with the toner particle, chemically or physically adsorbing the charge control agent onto the toner particle (resin or pigment), or chelating the charge control agent to a functional group incorporated into the toner particle.

The charge control agent acts to impart an electrical charge of selected polarity onto the toner particles. Any number of charge control agents described in the art can be used. For example, the charge control agent can be provided in the form of metal salts consisting of polyvalent metal ions and organic anions as the counterion. Suitable metal ions include, but are not limited to, Ba(II), Ca(II), Mn(II), Zn(II), Zr(IV), Cu(II), Al(III), Cr(III), Fe(II), Fe(III), Sb(III), Bi(III), Co(II), La(III), Pb(II), Mg(II), Mo(III), Ni(II), Ag(I), Sr(II), Sn(IV), V(V), Y(III), and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, lauric acid, tallic acid, and the like.

Preferred negative charge control agents are lecithin and basic barium petronate. Preferred positive charge control agents include metallic carboxylates (soaps), for example, as described in U.S. Pat. No. 3,411,936 (incorporated herein by reference). A particularly preferred positive charge control agent is zirconium tetraoctoate (available as Zirconium HEX-CEM from OMG Chemical Company, Cleveland, Ohio).

The preferred charge control agent levels for a given toner formulation will depend upon a number of factors, including the composition of the polymeric binder, the pigment used in making the toner composition, and the ratio of binder to pigment. In addition, preferred charge control agent levels will depend upon the nature of the electrophotographic imaging process. The level of charge control agent can be adjusted based upon the parameters listed herein, as known in the art. The amount of the charge control agent, based on 100 parts by weight of the toner solids, is generally in the range of 0.01 to 10 parts by weight, preferably 0.1 to 5 parts by weight.

The conductivity of a liquid toner composition can be used to describe the effectiveness of the toner in developing electrophotographic images. A range of values from $1\times10^{-11}$ mho/cm to $3\times10^{-10}$ mho/cm is considered advantageous to those of skill in the art. High conductivities generally indicate inefficient association of the charges on the toner particles and is seen in the low relationship between current density and toner deposited during development. Low conductivities indicate little or no charging of the toner particles and lead to very low development rates. The use of charge control agents matched to adsorption sites on the toner particles is a common practice to ensure sufficient charge associates with each toner particle.

Other additives may also be added to the formulation in accordance with conventional practices. These include one or more of UV stabilizers, mold inhibitors, bactericides, fungicides, antistatic agents, gloss modifying agents, other polymer or oligomer material, antioxidants, and the like.

The particle size of the resultant charged toner particles can impact the imaging, fusing, resolution, and transfer characteristics of the toner composition incorporating such particles. Preferably, the volume mean particle diameter (determined with laser diffraction) of the particles is in the range of about 0.05 to about 50.0 microns, more preferably in the range of about 3 to about 10 microns, most preferably in the range of about 1.5 to about 5 microns.

As noted above, in electrography, a latent image is typically formed by (1) placing a charge image onto the dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259. Images formed by the present invention may be of a single color or a plurality of colors. Multicolor images can be prepared by repetition of the charging and toner application steps.

In electrophotography, the electrostatic image is typically formed on a drum or belt coated with a photoreceptive element by (1) uniformly charging the photoreceptive element with an applied voltage, (2) exposing and discharging portions of the photoreceptive element with a radiation source to form a latent image, (3) applying a toner to the latent image to form a toned image, and (4) transferring the toned image through one or more steps to a final receptor sheet. In some applications, it is sometimes desirable to fix the toned image using a heated pressure roller or other fixing methods known in the art.

All patents, patent documents, and publications cited herein are incorporated by reference as if individually incorporated. Unless otherwise indicated, all parts and percentages are by weight and all molecular weights are weight average molecular weights. The foregoing detailed description has been given for clarity of understanding only. No unnecessary limitations are to be understood therefrom. The invention is not limited to the exact details shown and described, for variations obvious to one skilled in the art will be included within the invention defined by the claims.

What is claimed is:

1. A liquid electrographic toner composition comprising:

a) a liquid carrier having a Kauri-Butanol number less than about 30 mL; and b) a plurality of toner particles dispersed in the liquid carrier, wherein the toner particles comprise
   i) a polymeric binder; and
   ii) a pigment comprising a first ionic dye component ionically complexed with a second ionic dye component in a predetermined ratio to form an ionically complexed colorant compound exhibiting a predetermined color, the colorant compound having a molecular weight of less than about 5000 Daltons and being substantially free of metals that are not covalently bonded to the colorant compound.

2. The toner composition of claim 1, wherein the colorant compound has a molecular weight of less than about 3000 Daltons.

3. The toner composition of claim 1, wherein the colorant compound has a molecular weight of less than about 2000 Daltons.

4. The toner composition of claim 1, wherein the first ionic dye component and the second ionic dye component have different charges.

5. The toner composition of claim 1, wherein the first ionic dye component and the second ionic dye component have the same charge, and the first ionic dye component and the second ionic dye component are ionically complexed with a colorless counterion.

6. The toner composition of claim 1, wherein the first ionic dye component and the second ionic dye component exhibit a color difference of at least about 10 $\Delta E^*$ units.

7. The toner composition of claim 1, wherein the first ionic dye component and the second ionic dye component exhibit a color difference of at least 20 $\Delta E^*$ units.

8. The toner composition of claim 1, wherein at least one of the dye components comprises a plurality of ionic functionalities.

9. The toner composition of claim 1, wherein the colorant compound comprises at least one colorless counterion.

10. The toner composition of claim 1, wherein all dye components in the colorant compound exhibit a color difference of less than about 10 $\Delta E^*$ units from each other.

11. The toner composition of claim 1, wherein the colorant compound further comprises a third ionic dye component.

12. A liquid electrographic toner composition comprising:
a) a liquid carrier having a Kauri-Butanol number less than about 30 mL; and
b) a plurality of toner particles dispersed in the liquid carrier, wherein the toner particles comprise
   i) a polymeric binder; and
   ii) an organic pigment comprising a ionic dye component and a second ionic dye component complexed to form ionically complexed compounds that together in a colorant composition exhibit a predetermined color, the ionically complexed compounds each having a molecular weight of less than about 5000 Daltons and being substantially free of metals that are not covalently bonded to the ionically complexed compounds.

13. The toner composition of claim 12, wherein the first and second counterion dye components exhibit a color difference of at least about 10 $\Delta E^*$ units.

14. The toner composition of claim 12, wherein the pigment further comprises a third ionic dye component.

15. A method of preparing a toner comprising:
a) preparing a pigment of a predetermined color, comprising
   i) identifying a first ionic dye component having an apparent color characteristic;
   ii) identifying a second ionic dye component having a known color characteristic;
   iii) determining the ratio of the first ionic dye component and the second ionic dye component required to obtain the predetermined color desired for the pigment; and
   iv) complexing the first ionic dye component and the second ionic dye component to form an ionically complexed colorant compound exhibiting the predetermined color, the colorant compound having a molecular weight of less than about 5000 Daltons and being substantially free of metals that are not covalently bonded to the colorant compound;
b) providing a binder;
c) providing a carrier liquid; and
d) combining the binder, pigment and carrier liquid in a manner to form a liquid toner composition.

16. A method of preparing a toner comprising:
a) preparing a pigment of a predetermined color, comprising
   i) identifying a first ionic dye component having an apparent color characteristic;
   ii) identifying a second ionic dye component having a known color characteristic;
   iii) determining the ratio of the first ionic dye component and the second ionic dye component required to obtain the predetermined color desired for the pigment; and
   iv) complexing the first ionic dye component and the second ionic dye component to form ionically complexed compounds that together in a colorant composition exhibit a predetermined color, the ionically complexed compounds each having a molecular weight of less than about 5000 Daltons and being substantially free of metals that are not covalently bonded to the colorant compound;
b) providing a binder;
c) providing a carrier liquid; and
d) combining the binder, pigment and carrier liquid in a manner to form a liquid toner composition.

17. A method of providing an image, comprising electrographically printing an image on a substrate using a toner of claim 1.

18. The method of claim 17, wherein the image is electrophotographically printed.

19. The method of claim 17, wherein the image is electrostatically printed.

20. A method of providing an image, comprising electrographically printing an image on a substrate using a toner of claim 12.

* * * * *